US009055830B2

(12) United States Patent
Tzur

(10) Patent No.: US 9,055,830 B2
(45) Date of Patent: Jun. 16, 2015

(54) DEVICE FOR ENSURING SMOOTH AND TIGHT FIT OF SHEET OVER MATTRESS

(71) Applicant: Eli Tzur, Ashdod (IL)

(72) Inventor: Eli Tzur, Ashdod (IL)

( * ) Notice: Subject to any disclaimer, the term of this patent is extended or adjusted under 35 U.S.C. 154(b) by 0 days.

(21) Appl. No.: 13/858,057

(22) Filed: Apr. 7, 2013

(65) Prior Publication Data

US 2013/0283528 A1 Oct. 31, 2013

(51) Int. Cl.
*A47C 21/02* (2006.01)
*A47G 9/04* (2006.01)

(52) U.S. Cl.
CPC ..... *A47G 9/04* (2013.01); *A47C 21/022* (2013.01)

(58) Field of Classification Search
USPC ..... 5/498, 482; 24/72.5
See application file for complete search history.

(56) References Cited

U.S. PATENT DOCUMENTS

| | | | | | |
|---|---|---|---|---|---|
| 267,498 | A | * | 11/1882 | Cox | 24/522 |
| 807,706 | A | * | 12/1905 | Allens | 24/72.5 |
| 959,763 | A | * | 5/1910 | Lehr | 5/498 |
| 1,368,286 | A | * | 2/1921 | Pearson | 24/327 |
| 1,619,853 | A | * | 3/1927 | Correa | 24/72.5 |
| 1,748,227 | A | * | 2/1930 | Hyams | 606/157 |
| 2,605,524 | A | * | 8/1952 | Marchese | 24/72.5 |
| 3,092,848 | A | * | 6/1963 | Gronvold | 5/495 |
| 4,276,667 | A | * | 7/1981 | Osbourne | 5/498 |
| 4,782,543 | A | * | 11/1988 | Hutton et al. | 5/658 |
| 4,829,617 | A | * | 5/1989 | Dameron | 5/658 |

* cited by examiner

*Primary Examiner* — Robert G Santos
*Assistant Examiner* — Richard G Davis

(57) ABSTRACT

A device designed to ensure a smooth and tight fit of the sheet over the mattress, which includes a locking pin or convex cap and a base comprising a horizontal, bottom plate and a vertical plate with a locking hole or protrusion, respectively, whereby the sheet may be fit smoothly and tightly over the base and the locking pin inserted into the locking hole, or the convex locking cap fit over the protrusion, thus ensuring a smooth and tight fit of the sheet over the mattress.

1 Claim, 13 Drawing Sheets

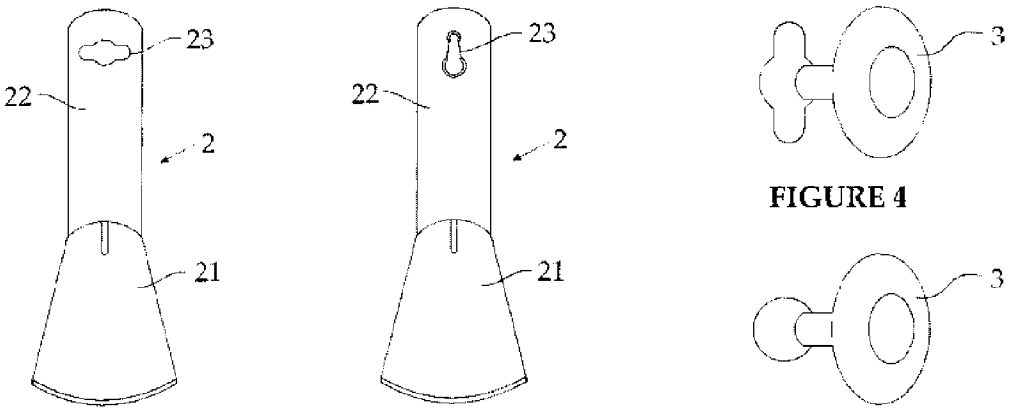
FIGURE 1
FIGURE 2
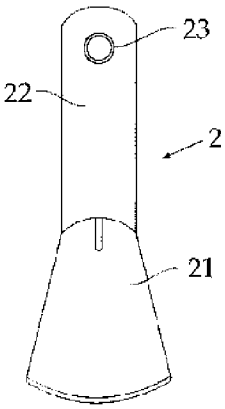
FIGURE 3
FIGURE 4
FIGURE 5
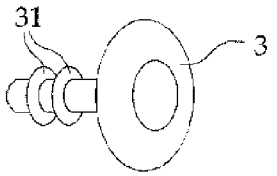
FIGURE 6
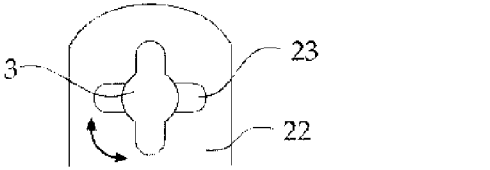
FIGURE 7
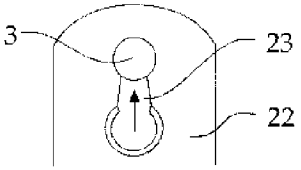
FIGURE 8
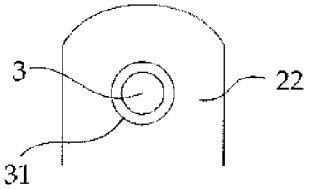
FIGURE 9
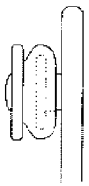
FIGURE 12
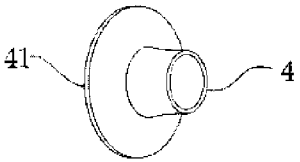
FIGURE 11
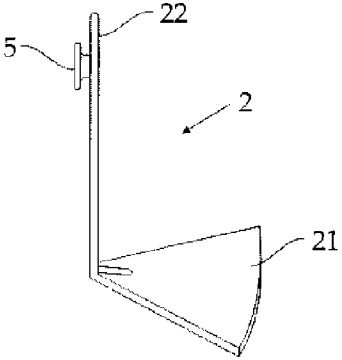
FIGURE 10

DEVICE FOR ENSURING SMOOTH AND TIGHT FIT OF SHEET OVER MATTRESS

TECHNICAL FIELD

The present invention refers to an innovative device designed to keep sheets smooth and tight over mattresses.

BACKGROUND ART

When making a bed it is customary to spread a sheet over the mattress and to tuck it under the mattress so as to ensure that it remains smooth and tight over the mattress. In addition, fitted sheets, which have a circumferential elastic band designed to keep the sheet smooth and tight over the mattress, have been available for many years. It is a known problem that when the bed is slept in or laid on, the sheet tends to come un-tucked, causing the user discomfort and annoyance. Even fitted sheets do not offer a full solution to the problem, for several reasons: Over time, the elastic band loses its elasticity due both to the passage of time and to repeated washing and it no longer ensures a smooth and tight fit of the sheet over the mattress. There are a variety of other problems involved in using sheets in the familiar manner, including the purchase of sheets that are not exactly the right size for the mattress (too small or too big); premature wearing of the elastic band which results in the user disposing of sheets that are otherwise in fine condition; the user's desire that the sheet be very smooth and tight over the mattress, especially in the summer time; and the fact that fitted sheets are inconvenient to use, and especially to fold and iron. The device, subject of the present invention, offers a good and effective solution to these problems.

DESCRIPTION OF THE DRAWINGS

The intention of the drawings attached to the application is not to limit the scope of the invention and its application.

The drawings are intended only to illustrate the invention and they constitute only one of its many possible implementations.

FIGS. 1-3 depict the base (2) with different shapes of locking holes (23).

FIGS. 4-6 depict a variety of locking pin (3) designs.

FIGS. 7-9 depict a variety of locking pins (3) inserted into corresponding locking holes (23).

FIG. 10 depicts the base (2) with a protrusion (5).

FIG. 11 depicts the convex cap (4).

FIG. 12 depicts the convex cap (4) when fitted over the protrusion (5).

Figure 14:
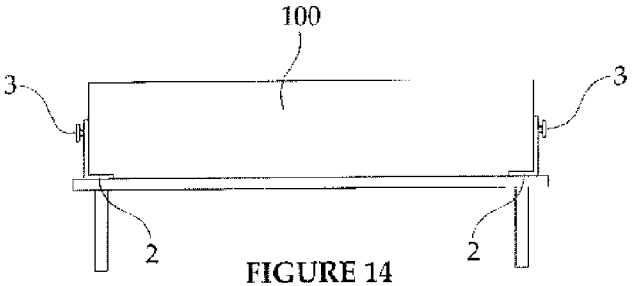
FIGS. 13-18 depict the device (1) in use.

Drawing No. 44 depicts the base (2) with a spacer protrusion (24).

Drawings Nos. 45-47 depict the vertical plate (22) with flexibility slits (25).

Drawings Nos. 48-52 depict the vertical plate (22) with a ratchet mechanism (26).

Drawing No. 53 depicts the base (222) with all of its components.

Drawing No. 54 presents the base (222) in perspective, from above.

Drawing No. 55 presents the base (222) in perspective, from below.

Drawings Nos. 56-61 depict the base (222).

Drawings Nos. 62-66 depict the pins (99) and the method of attaching the device (2) to the mattress (100).

Drawing No. 67 depicts the device 50 with its components,

Drawing No. 68 depicts the device 60 with its components,

THE INVENTION

The main objective of the present invention is to provide a device that keeps the sheet smooth and tight over the mattress. Additional objectives of the present invention are to provide a device, as mentioned, that is convenient, effective and easy to use and that fits a variety of mattress and sheet sizes. It should be mentioned that using the device does not damage the sheet, since it can be manufactured from a variety of materials so that the parts that come in contact with the sheet are made of rubber or flexible and rounded plastic, or other such materials.

The device (1), subject of the present invention, comprises an L-shaped base (2) and a locking pin (3). The L-shaped base comprises a horizontal bottom plate (21) to which a vertical plate (22) is attached. The vertical plate (22) has one or more locking holes (23).

Using the Device (1):

In order to smooth and tighten the sheet over the mattress (100), four bases (2) are positioned at each of the mattress' corners such that the bottom plate (21) is placed under the mattress between the bed base and the mattress and is held in place by the mattress' weight, and the vertical plate (22) is parallel and in close contact with the side of the mattress' corner. The sheet is then spread over the mattress, smoothed over the vertical plate (22), and held in place there by inserting the locking pin (3) into the locking hole (23). After repeating this step for all four devices (1) at all four corners of the mattress, a smooth and tight fit of the sheet over the mattress is obtained. Despite the above description, the devices (1) do not have to be positioned only at the corners of the mattress, but can also be positioned along the four sides of the mattress.

The base (2), as mentioned, comprises a horizontal bottom plate (21) and a vertical plate (22) with a locking hole (23). The bottom plate (21) should be wide and can be fan-shaped so that the side at which it is joined to the vertical plate (22) is narrow and the free side is wide. This increases the surface area of the bottom plate (21) so that the weight of the mattress exerts more pressure on it, preventing it from moving in cases in which the bed base is not wooden and the device (1) is not screwed in place.

Figure 33:
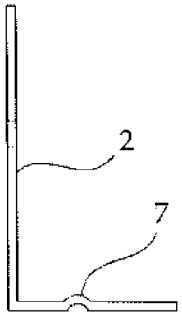
FIGS. 33-39 depict the base (2) with a sharpened pin of rubber stopper or bend (7).
Figure 34:
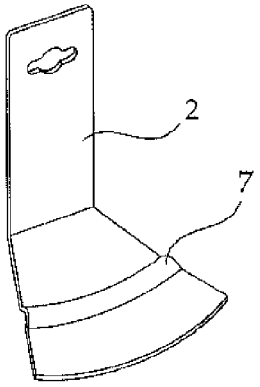
Figure 35:
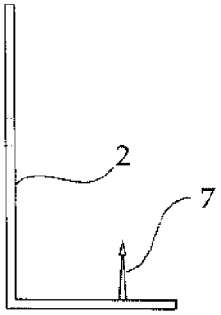
Figure 36:
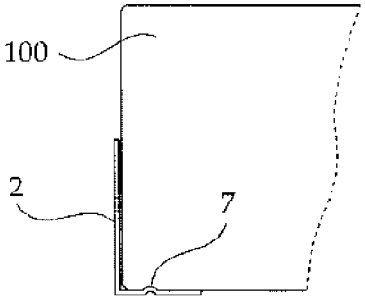
Figure 37:
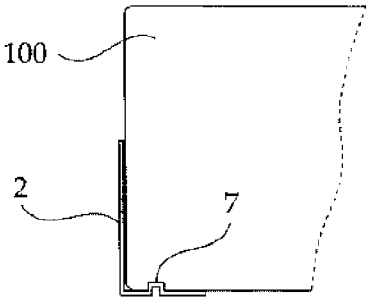
Figure 38:
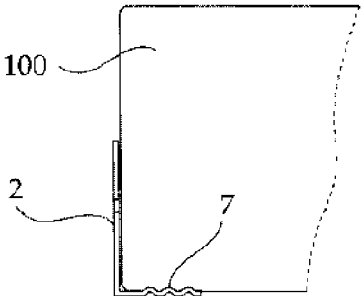
Figure 39:
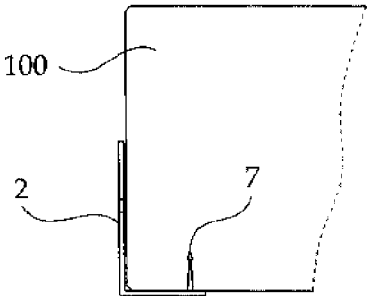
Figure 40:
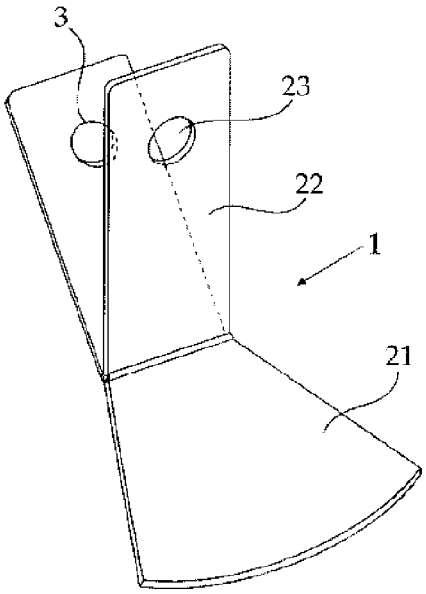
Figure 41:
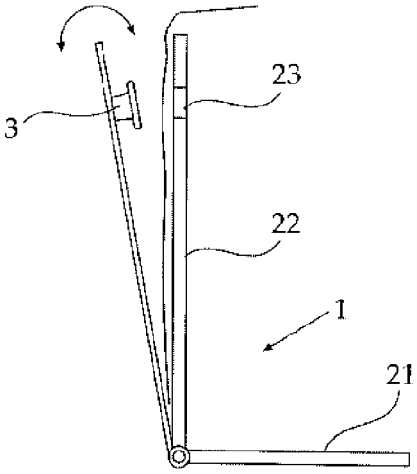
FIGS. 41-43 depict the device (1) whereby the locking pin (3) is located on a parallel plate that it joined to the base (2) by means of a hinge.
Figure 42:
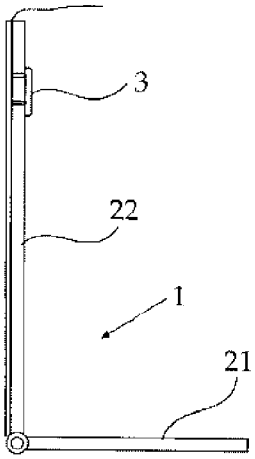
Figure 43:
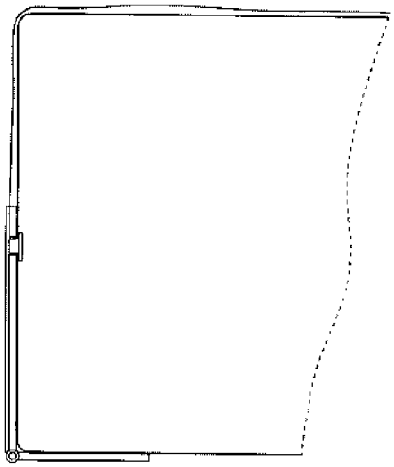
Figure 44:
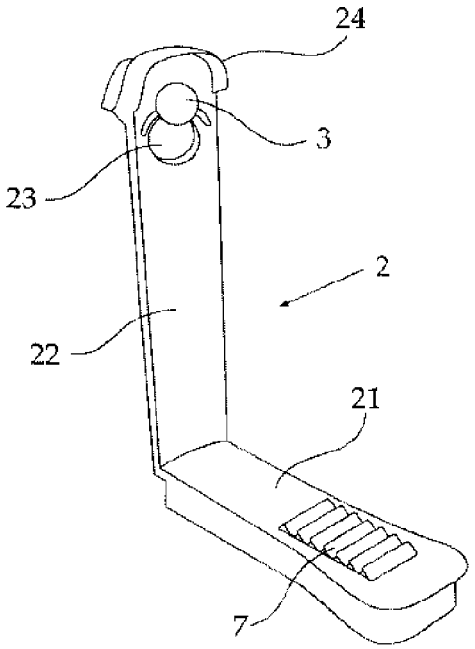
Figure 45:
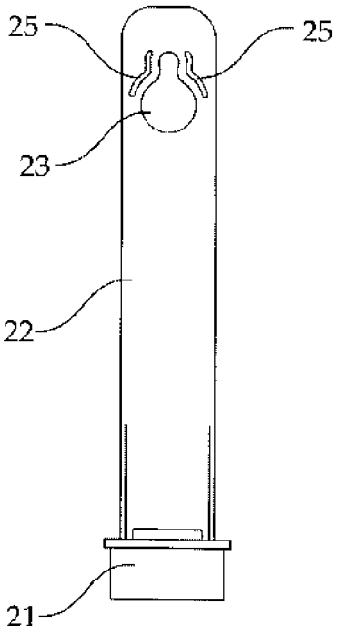
Figure 46:
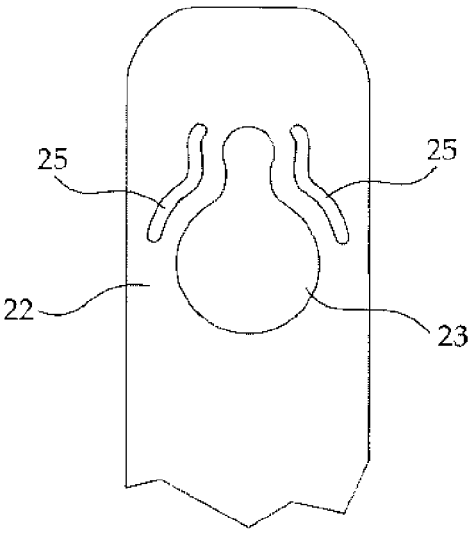
Figure 47:
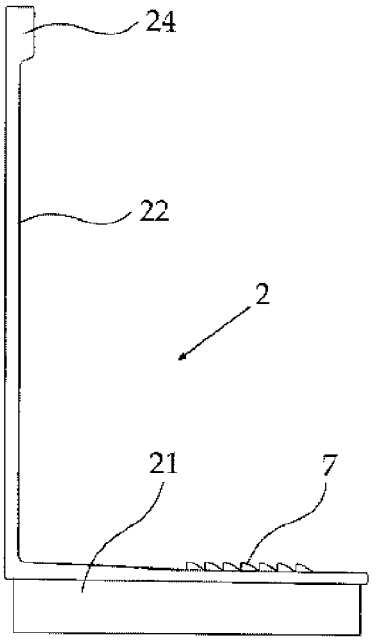
Figure 48:
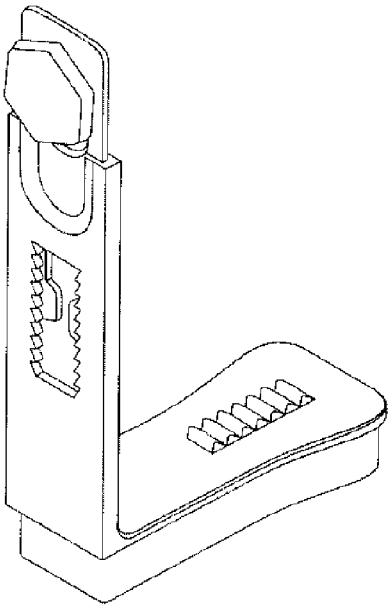
Figure 49:
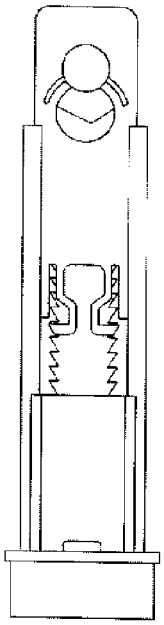
Figure 50:
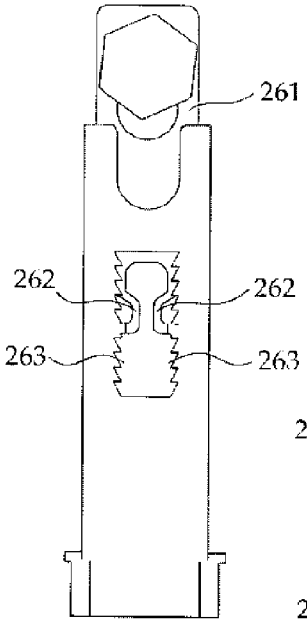
Figure 51:
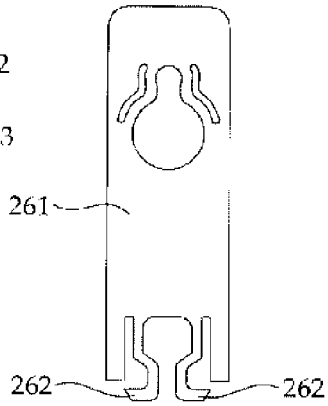
Figure 52:
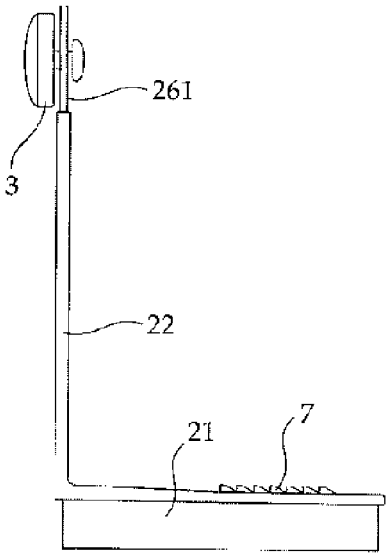
Figure 53:
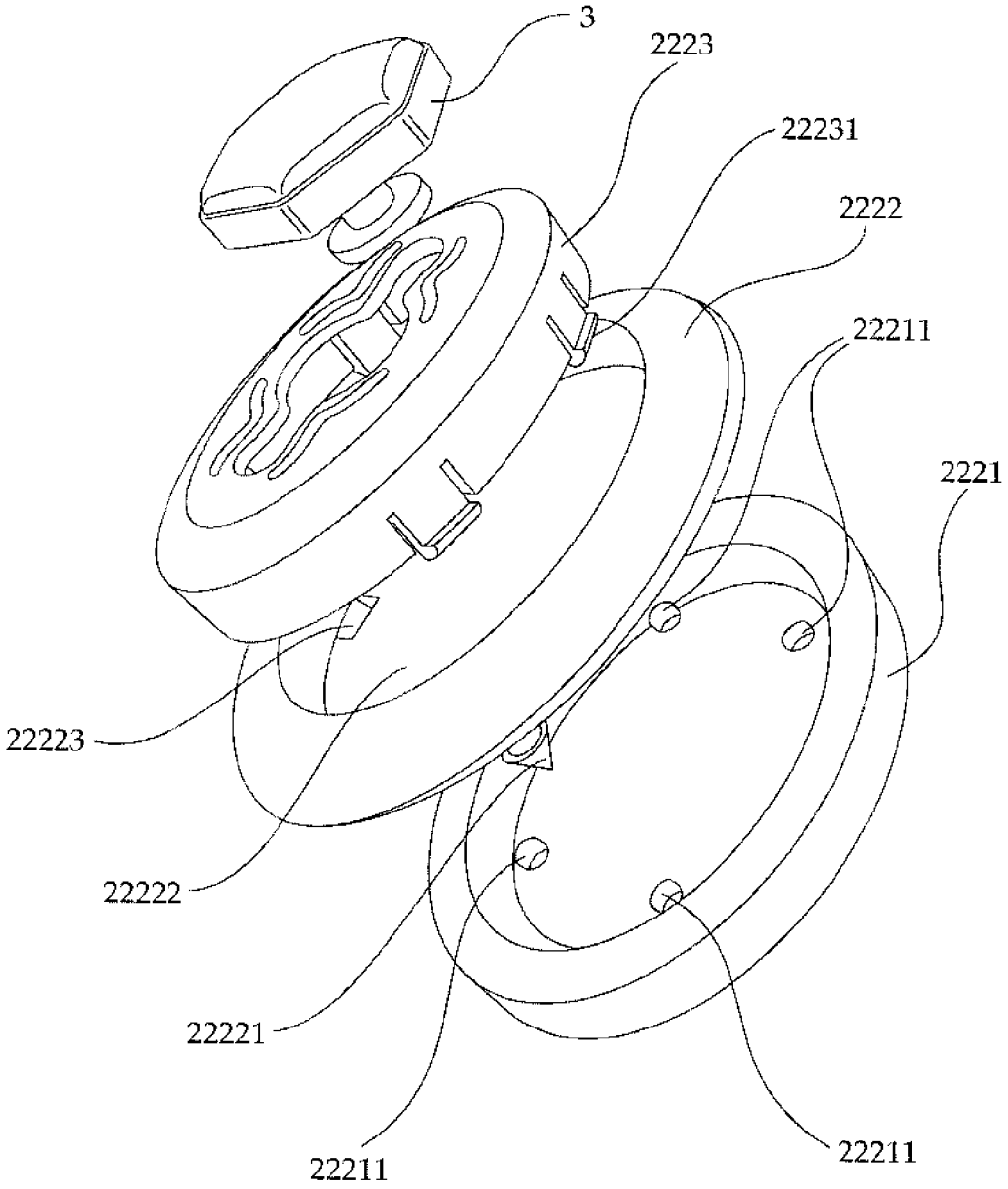
Figure 54:
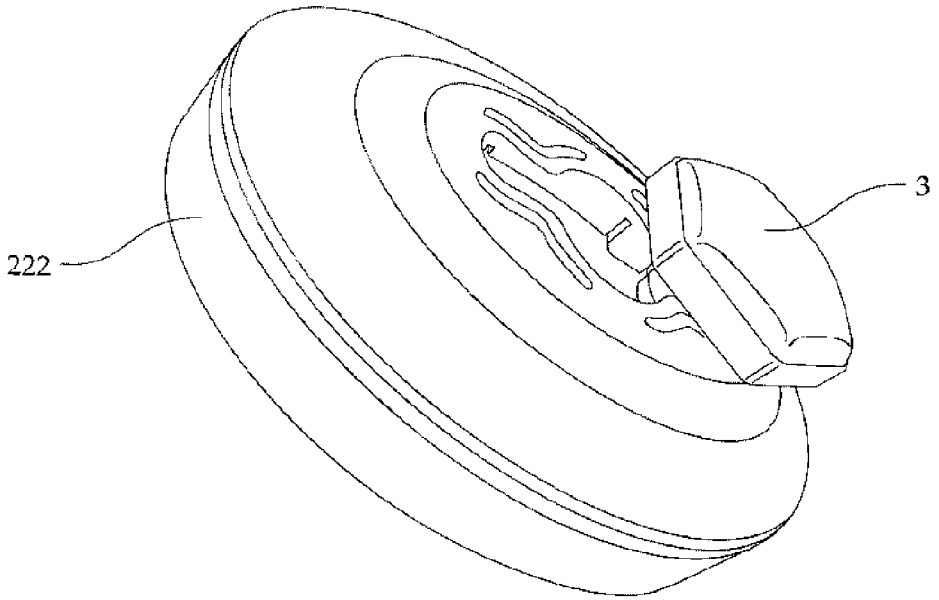
Figure 55:
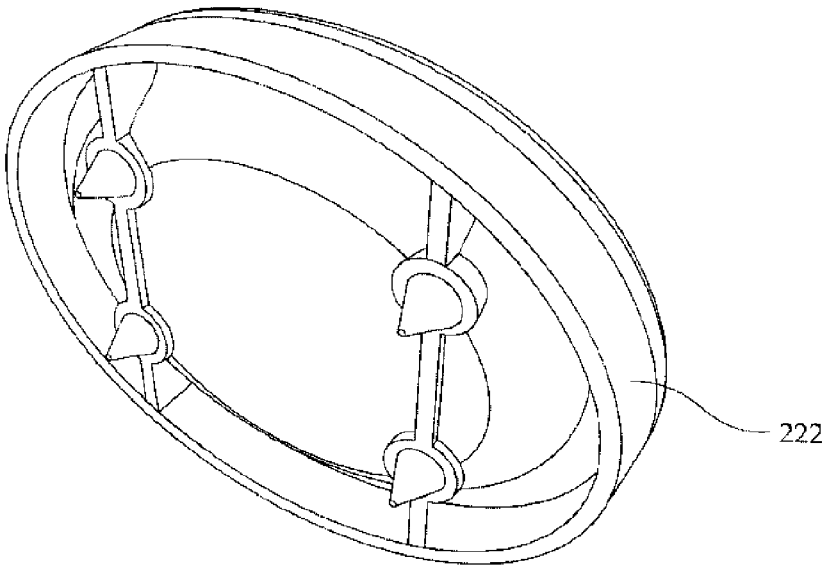
Figure 56:
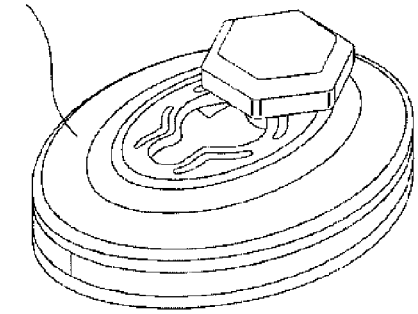
Figure 57:
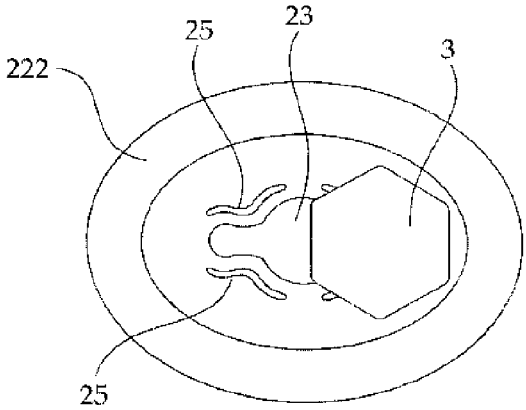
Figure 58:
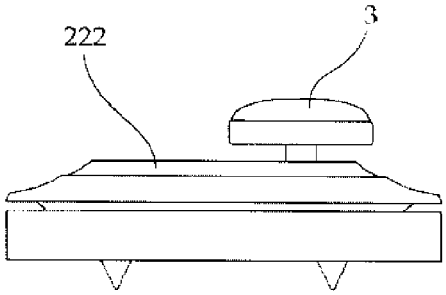
Figure 59:
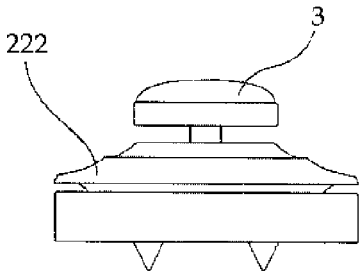
Figure 60:
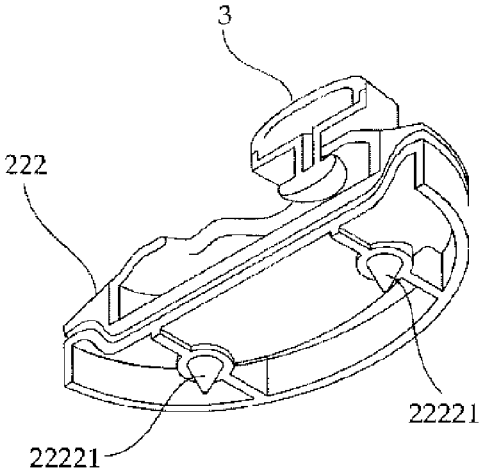
Figure 61:
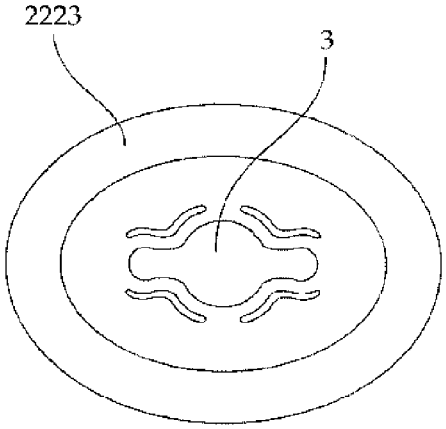
Figure 62:
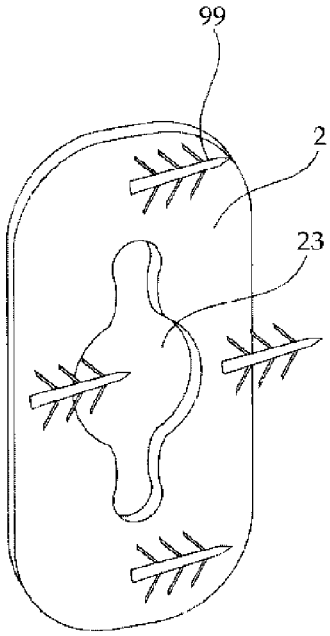
Figure 63:
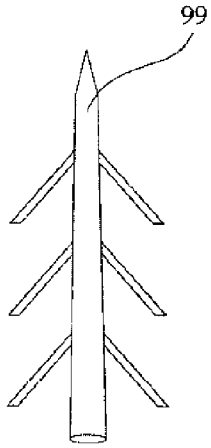
Figure 64:
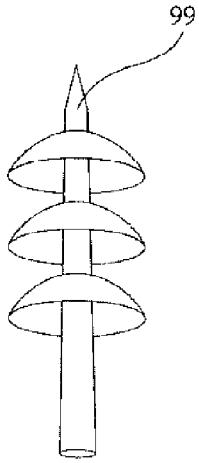
Figure 65:
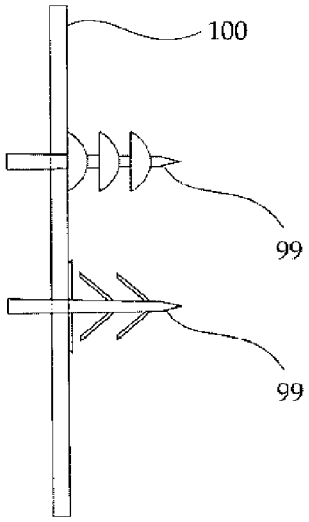
Figure 66:
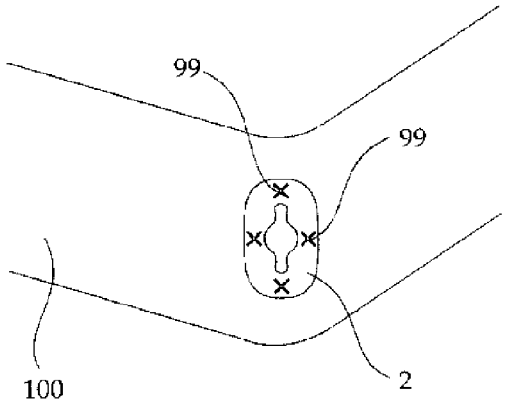

Fixing the Base (2) to the Mattress (100):

The base (2) may be affixed to the mattress by using a screw (8) to attach the bottom plate (21) to the bottom of the mattress (100) (as depicted for instance in FIGS. 35-39 or to the base board of the bed. Another effective option is to use a stopper (7), i.e. a protrusion in the bottom plate (21) that causes the base (2) to stay firmly in place beneath the mattress. FIGS. 33, 34 and 36 depict the base (2) including a stopper (7) in the form of a raised corrugation. FIG. 37 depicts a stopper (7) with a raised, square shaped strip while the stopper (7) in FIG. 38 consists of several corrugations. In general, the shape of the stopper (7) can vary, as long as it is a protrusion. The stopper (7) may also consist of a rubber surface that has a higher friction coefficient than the smooth plate, and which is affixed to the top of the bottom plate (21). Alternatively, the bottom plate (21) itself may be made from a material with a high friction coefficient that will cause the bottom plate (21) to remain in place beneath the mattress (100).

The Locking Pin (3) and Locking Hole (23):

When the sheet is spread over the mattress, the user inserts the locking pin (3) into the locking hole (23) and by doing so, fixes the sheet to the device (1), ensuring a smooth and tight fit over the mattress. To prevent the locking pin (3) from slipping out of the locking hole (23), the locking pin (3) and the locking hole (23) should be shaped so that the locking is firm and can be open only by the user and not spontaneously. The locking pin (3) and the locking hole (23) accordingly can and should be shaped so as to ensure firm locking as mentioned, as is described in the drawings attached to the application. To ensure the sheet remains undamaged, the locking pin (3) can and should be convex and rounded, with no protrusions or sharp edges, and the locking hole (23) should, accordingly, have rounded, not sharp, edges. The base (2) and the locking pin (3) should also be made of plastic or of another, slightly flexible material so as to prevent damage to the sheet, or at least to the part of the sheet that is inserted into the locking hole (23) along with the locking pin (3). In addition, the base (2) and the locking pin (3) can have a full or partial soft, rubber coating so as to prevent damage to the sheet. The locking pin (3) can be separate from the base (2) although it can also be attached to it by means of a cord or it can be mounted on a parallel plate that is attached to the base (2) by a hinge, as depicted for instance in Drawings Nos. 19.

Example No. 1: FIGS. 1-3 depicts the base (2), which comprises a bottom plate (21) and a vertical plate (22) with an elongated horizontal locking hole (23) and a round hole in the middle. FIGS. 4-6 depicts the corresponding locking pin (3) that is inserted into the locking hole (23) depicted in FIGS. 4-6, whereby it is shaped like an elongated horizontal piece with a cylinder in the middle. FIGS. 7-9 depicts the manner in which the locking pin (3) is inserted into the locking hole (23) and is rotated a quarter of a turn to lock the sheet into the device (1). Example No. 2 is depicted in FIGS. 1, 4 and 7, in which the locking hole (23) is an elongated and tapered vertical hole with a narrow top and a wide bottom. The locking pin (3) that corresponds to this locking hole (23) is cylinder-shaped so that the locking pin (3) is inserted into the bottom, wide part of the locking hole (23) and then lifted up in order to lock it in place. Example No. 3 is depicted in FIGS. 2, 5 and 8, in which the locking hole (23) is round. The corresponding locking pin (23) is cylinder-shaped and has one or more rings (31) that are made of a flexible material, such as flexible plastic, so that when the locking pin (3) is inserted into the locking hole (23), the rings (31) are also inserted into the locking hole (23). When the locking pin (3) has rings (31), as described above, it is recommended that they too be flexible both in order to be inserted into the locking hole (23) and to avoid damaging the sheet. The examples presented above are only some of the wide variety of possible designs for locking holes (23) and their corresponding locking pins (3). The present invention and patent application cover and refer to this wide variety of options.

Locking Using Convex Cap and Protrusion:

The sheet may be locked into the device (1) using a convex cap (4) that fits over a protrusion (5). Thus, instead of inserting a locking pin into a locking hole, as described above, there is a horizontal protrusion (5) on the exterior part of the vertical plate (22), as described for instance in FIG. 10, and a corresponding convex cap (4) with a central hole (41), as depicted for instance in FIG. 11, such that the central hole (41) in the convex cap (4) matches the head of the protrusion (5), enabling to lock the sheet into the device, as depicted for instance in FIG. 12.

Figure 16:
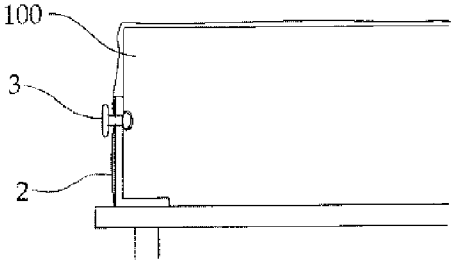
Figure 18:
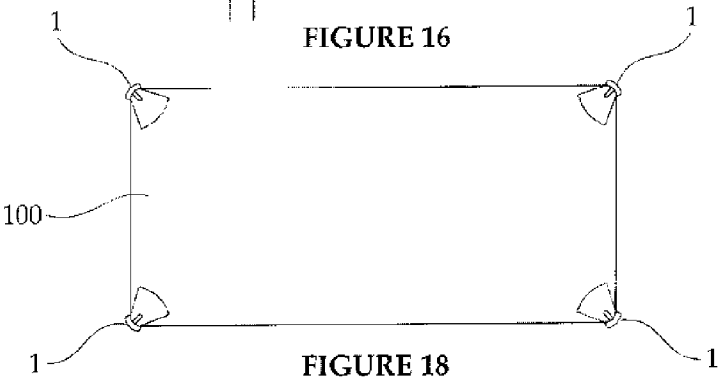
Figure 13:
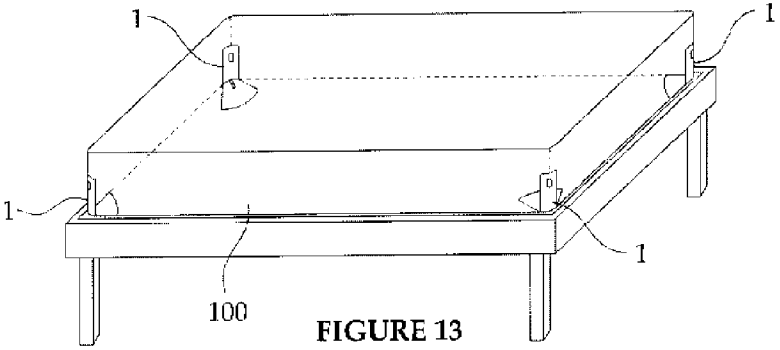
Figure 15:
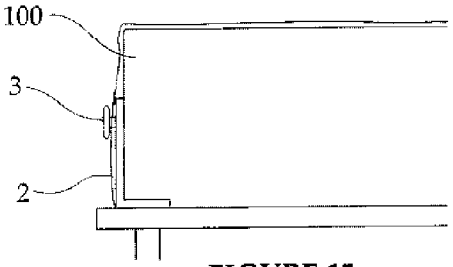
Figure 17:
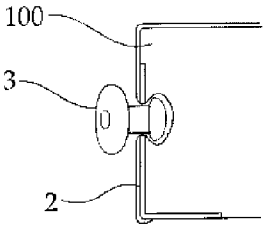
Figure 19:
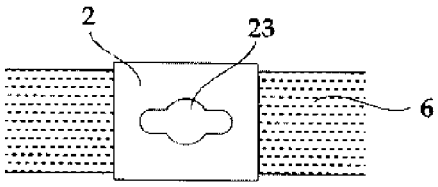
FIGS. 19-22 depict the attaching of various bases (2) to the elastic band (6).
Figure 20:
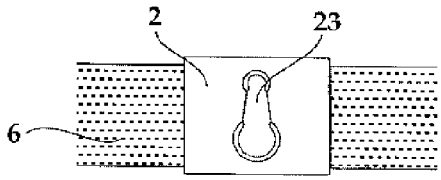
Figure 21:
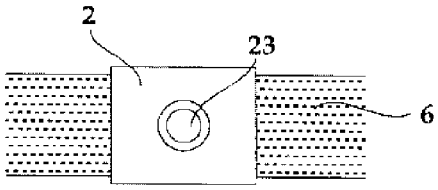
Figure 22:
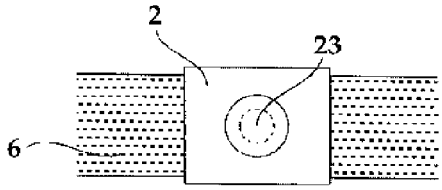

Drawings for Illustration:

FIG. 13 presents a mattress (100) in perspective, with four devices (1), one at each corner. FIG. 14 presents a side view of the mattress (100) and the devices (1). FIGS. 15-16 depict one corner of the mattress (100) with the device (1) in locked position. FIG. 17 depicts the locking pin (3) in the locking hole (23) of the base (2). FIG. 18 depicts a mattress (100) with four devices (1) at its four corners.

Figure 23:
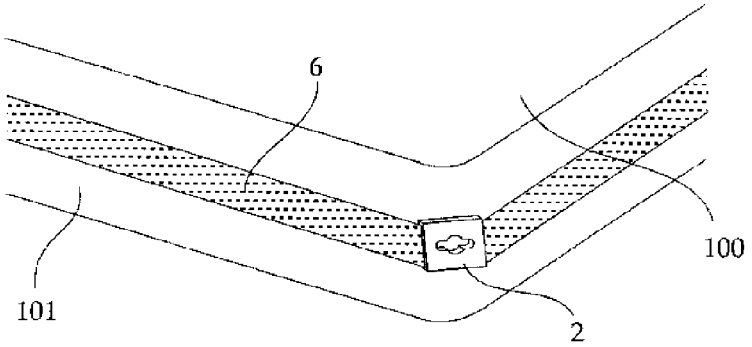
FIGS. 23-24 depict the use of a base (2) with the elastic band (6) and the mattress (100).
Figure 24:
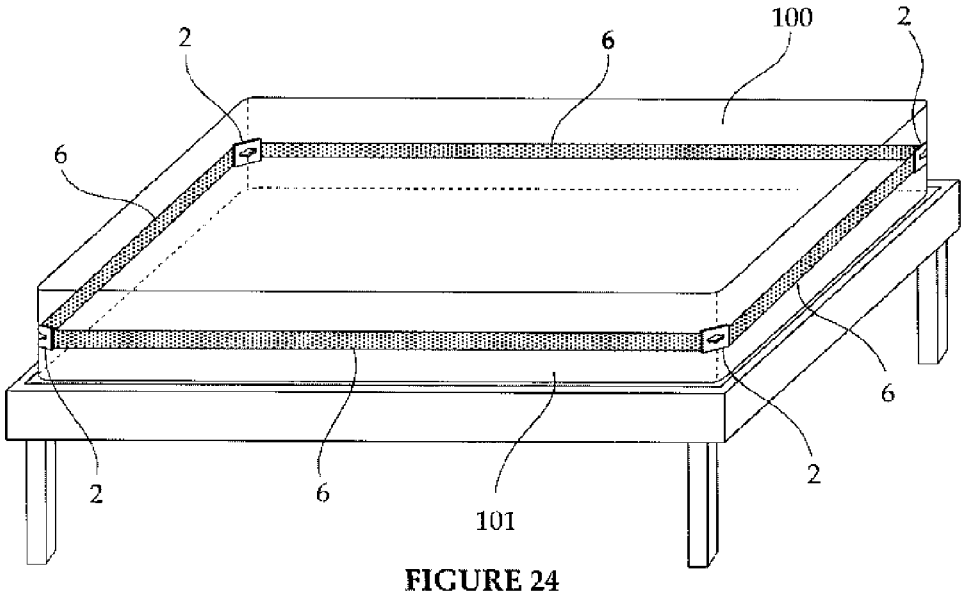
Figure 29:
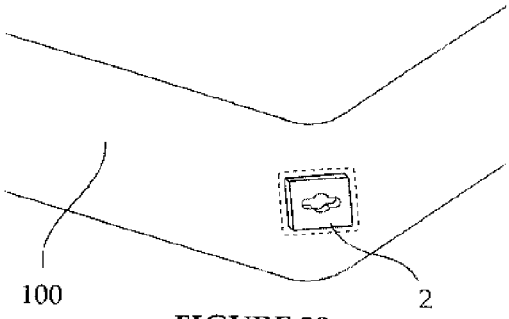
FIGS. 29-32 depict the base (2) attached to the corners of the mattress (100).
Figure 25:
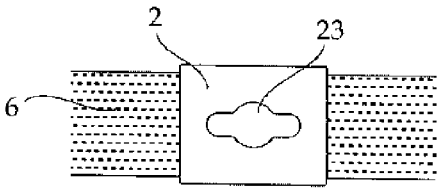
FIGS. 25-28 depict the base (2) with a variety of designs of locking holes (23).
Figure 30:
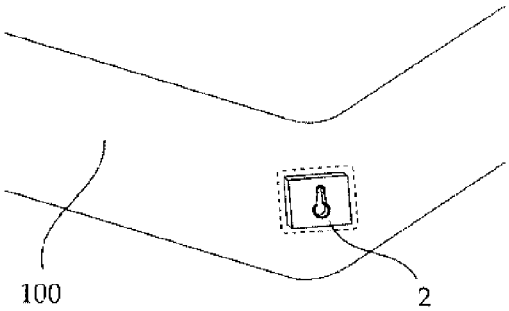
Figure 26:
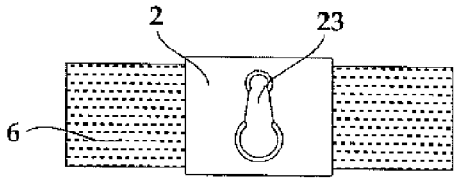
Figure 31:
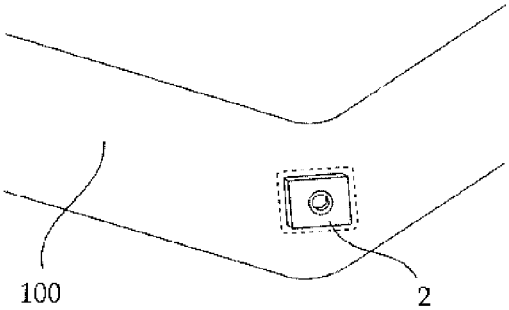
Figure 27:
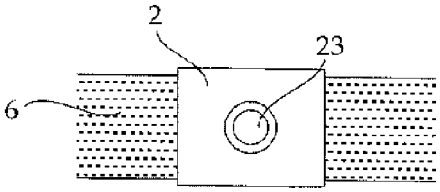
Figure 32:
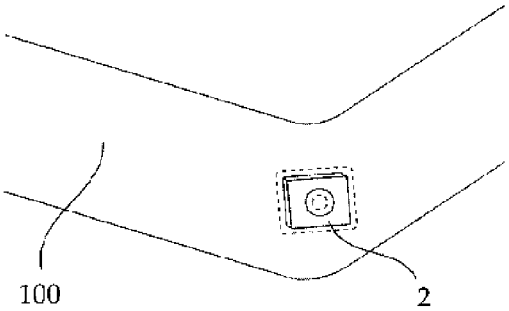
Figure 28:
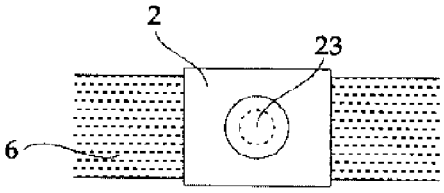

The second embodiment of the invention refers to a base (2) that is attached to the mattress by means of a circumferential elastic band (6) that encircles the vertical side (101) of the mattress (100) and thus fixes the bases (2) to the corners or sides of the mattress (100). In the second embodiment of the invention, the base (2) is a thick plate with a locking hole (23), as depicted in FIGS. 19-22, which show several shapes of locking holes (23) or protrusions (5). FIGS. 23-24 depict a mattress (100) with a circumferential elastic band (6) with four bases (2).

The third embodiment of the invention refers to a base (2) that is sewn or attached to the mattress using another attaching device during the mattress' manufacturing process (built-in). FIGS. 25-28 depict the base (2) with several locking holes (32) and a protrusion (5). FIGS. 29-32 depict a mattress (100) with bases (2) attached.

The advantage of the device (1) over other similar devices is that it is easy and convenient to use and fulfills several needs. The device is compact and can be screwed onto beds with wooden bed bases. The advantage of this is that the device can function regardless of whether the sheet is slightly small or large, and whether or not it is equipped with an elastic band. The device enables the user to fit the sheet over the mattress in a smooth and tight manner, according to need, and ensures that it stays that way and does come un-tucked or loose. Using the device, subject of the invention, does not require the user to lift the mattress. The locking accessories may have various shapes or designs, which add to the aesthetics of the solution. Using the device enables to manufacture mattresses with bases already attached at corners and other required locations, regardless of the size and kind of mattress.

Spacer Protrusion (24):

The device (1), which comprises a base (2) with a horizontal bottom plate (21) and a vertical plate (22) with a locking hole (23), can also have a spacer protrusion (24), as depicted for instance in Drawing No. 44. The spacer protrusion (24) is actually a horizontal protrusion located near the lock hole (23), on the side that faces the mattress (100) when the device (1) is in use. The spacer protrusion (24) can be of a variety of shapes, such as an arced protrusion above the lock hole (23), as depicted in Drawing No. 44, or any other shape. The purpose of the spacer protrusion (24) is to distance the upper end of the vertical plate (22) and prevent close contact between the edge of the locking pin (3) and the mattress (100) so as to prevent it from rubbing against the mattress (100) or damaging it in any way.

Flexibility Slits (25):

The device (1) can also have two flexibility slits (25), as depicted for instance in Drawings Nos. 45 and 46. The flexibility slits are in fact thin slits in the vertical plate (22) and are positioned very close to the circumference of the locking hole (23). The device (1) should have two flexibility slits (25): one to the right of the locking hole (23) and the other to its left. The flexibility slits (25) impart elasticity to the strip located between the two slits (25) themselves and the locking hole (23). As a result of this increased flexibility, the locking hole (23) can expand when the locking pin (3) is inserted into it along with the sheet. The purpose of the flexibility slits (25) is, therefore, to enable the locking hole (23) to expand under pressure so that the sheet, which is trapped between the locking pin (3) and the locking hole (23), does not tear. In other words, the flexibility slits (25) and the flexibility they impart, relieve some of the pressure on the sheet. This enables the user to use the device (1) with sheets of different thicknesses without the risk of tearing or damaging them.

Tooth-Like Stopper (7):

The device (1) can also be equipped with a stopper (7) that is attached to the upper part of the horizontal bottom plate (21) or is an integral part thereof. The stopper (7) may have a tooth-like structure, as depicted for instance in Drawings No. 44, 45 and 46.

Thick Horizontal Bottom Plate (21):

The horizontal bottom plate (21), on which the mattress is placed, can and should be relatively thick so that the mattress (100) can hold the base (2) in place in a better and more effective manner. Drawings Nos. 44, 45 and 47 depict the base (2) with an especially thick horizontal bottom plate.

Vertical Plate (22) with Ratchet Mechanism (26):

The vertical plate (22) can be equipped with a ratchet mechanism (26), as depicted for instance in Drawings No. 48-52. Any average expert in the field is familiar with the structure of a ratchet mechanism and so there is no need to elaborate more than is mentioned above and depicted in the drawings. The aforementioned drawings depict only one of many possible ways of incorporating a ratchet mechanism (26) in the vertical plate (22). The ratchet mechanism (26) depicted in the drawings comprises a top plate (261), depicted in Drawing No. 51, that constitutes the upper part of the vertical plate (22) and has a pair of locking teeth (262) at its lower end. The bottom part of the vertical plate (22) has two set of teeth (263) with which the locking teeth (262) interlock, enabling the user to control the overall length of the vertical plate (22). The purpose of the ratchet mechanism (26) is to enable the user to adapt the length of the vertical plate (22) to the thickness of the mattress (100) and to enable the sheet to be pulled and tightened more efficiently.

Vertical Plate (22) is Made of Elastic Material:

The vertical plate (22) may be made, entirely or partially, from an elastic material, such as rubber, so as to enable the user to stretch the vertical plate (22) to fit the thickness of the mattress (100) and also to enable the sheet to be pulled and tightened more efficiently.

The embodiment of the device (1) according to which it is intended to be attached permanently to the mattress (100) has already been described, for instance, in Drawings Nos. 19-22 and 25-28. The device (1) can also be assembled as described in Drawings Nos. 53-69. In this embodiment, the device (1) comprises a base (222) and a locking pin (3). The base (222) has a bottom plate (2221), a middle plate (2222) and a top plate (2223). The device (1) is designed to be permanently attached to the mattress (100) so that the bottom plate (2221) is inside the mattress (100) and is positioned up against the mattress covering (ticking) from the inside, and the middle plate (2222) is positioned up against the mattress ticking from the outside. Thus, when the middle plate (2222) is fastened to the bottom plate (2221), it is in fact fastened to the mattress ticking. The top plate (2223) is now attached to the middle plate (2222) resulting in the base (222), including all of its components, being firmly fastened to the mattress (100).

The bottom plate (2221) is a flat plate with several holes (22211). The middle plate (2222) is a flat plate with several pins (22221) that correspond in number and in location to the number and location of the holes (22211) in the bottom plate (2221). In addition, there is a recess (22222) in the upper part of the middle plate (2222). The pins (22221) are designed to be inserted through the mattress ticking into the holes (22211), thus fastening the plates together. The said pins can and should be flanged (bee-stinger shape) so that after being inserted they cannot be easily extracted. The top plate (2223) is a flat plate that is designed to fit inside the recess (22222) and stay firmly in place. This can be brought about in several ways, for instance using clips (22231) and corresponding holes (22223). The locking hole (23) is located in the top plate (2223) as are the flexibility slits (25), if present, as described above. In order to enable the user to flip over the mattress from time to time, as many people do, the locking hole (23) can and should be bi-directional, as depicted for instance in Drawing No. 61. In other words, the locking hole (23) should be a round hole with extensions in both up and down directions.

Pins (99) for Fastening the Base (2) to the Mattress (100):

The base (2), which is intended to be permanently fastened to the mattress (100), can also be attached using flanged pins (99) that are shaped like a bee-stinger; rings or protrusions on the pins (99) prevent the pins from being easily extracted after being inserted into the mattress (100), as depicted in Drawings Nos. 62-66.

Figure 67:
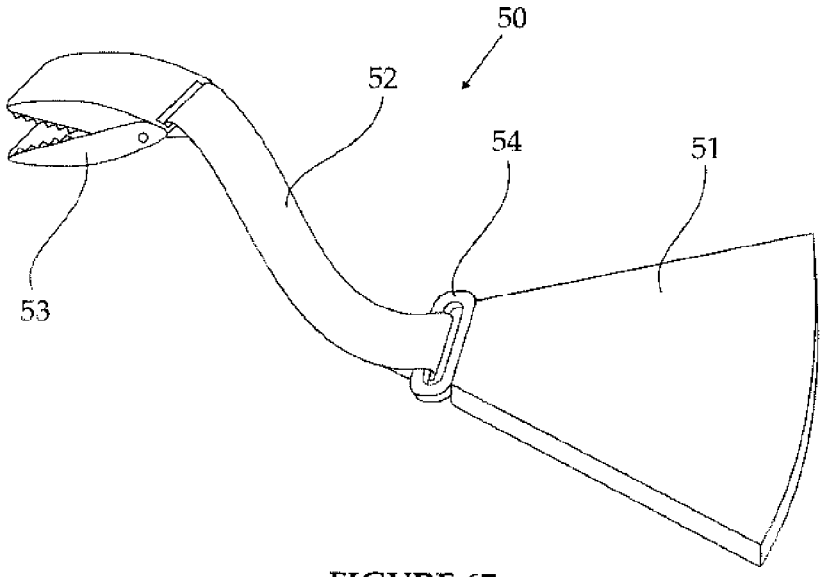

Another embodiment of the present invention is the Device (50) which is described in FIG. 67 and which comprising of a base plate (51), rubber strip (52) and a clip (53). Wherein the rubber strip (52) is connected in one end to the base plate (51) by an attachment means such as a ring (54) and wherein the second end of the rubber strip (52) is connected to the clip (53). The use of the Device 50 is as follow: Putting the base plate (51) under the mattress (100) and after tightening the sheet over the mattress (100) closing the clip (53) on the sheet. The rubber strip (52) makes it sure that the sheet will remain tight.

Figure 68:
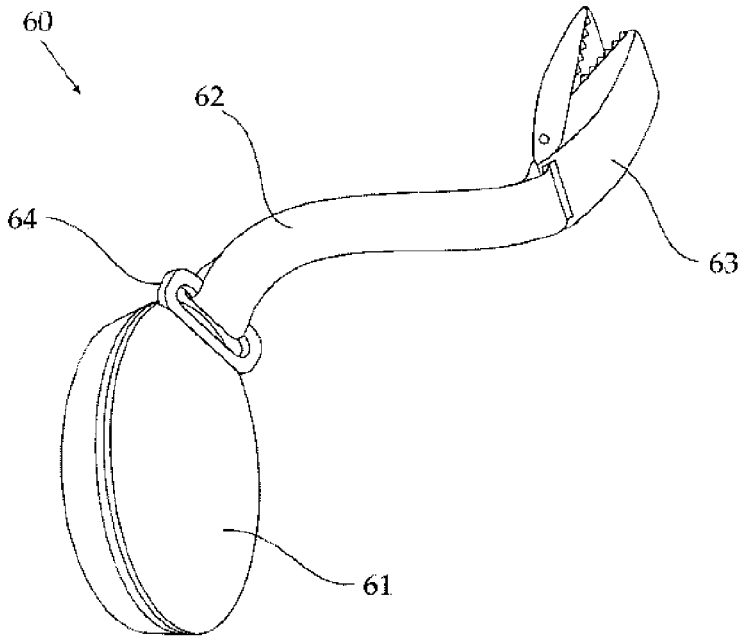

Another embodiment of the present invention is the Device (60) which is described in FIG. 68 and which comprising of a base plate (61), rubber strip (62) and a clip (63). Wherein the rubber strip (62) is connected in one end to the base plate (61) by an attachment means such as a ring (64) and wherein the second end of the rubber strip (62) is connected to the clip (63). The base plate (61) is aimed to be fixed permanently to the bottom or the side of the mattress (100). The use of the Device 60 is as follow: As it said above, the base plate (61) is being fixed permanently to the bottom or the side of the mattress (100). After tightening the sheet over the mattress (100) closing the clip (63) on the sheet. The rubber strip (62) makes it sure that the sheet will remain tight.

What is claimed is:

1. A device designed to ensure a smooth and tight fit of a sheet over a mattress, comprising:

a locking pin and a base; wherein said base is an L-shaped and comprises a horizontal bottom plate and a vertical plate with a locking hole;

wherein said locking pin is designed to be inserted into said locking hole and is capable of establishing a firm locking;

wherein said horizontal bottom plate includes a friction stopper on the upper side, facing the mattress;

wherein said vertical plate includes a spacer protrusion near said locking hole; whereby said spacer protrusion is designed to prevent close contact between edge of said locking pin and the mattress;

wherein said vertical plate also has two narrow flexible slits near the perimeter of said locking hole; whereby said two narrow flexible slits are designed to impart elasticity to strips located between said two slits and said locking hole and to enable said locking hole to expand under pressure.

* * * * *